US012024918B2

(12) United States Patent
Kamei

(10) Patent No.: US 12,024,918 B2
(45) Date of Patent: Jul. 2, 2024

(54) MULTIPLEX WATER CUTOFF WALL

(71) Applicant: Masamichi Kamei, Tokyo (JP)

(72) Inventor: Masamichi Kamei, Tokyo (JP)

(73) Assignee: Land Business Co., Ltd., Tokyo (JP)

( * ) Notice: Subject to any disclaimer, the term of this patent is extended or adjusted under 35 U.S.C. 154(b) by 134 days.

(21) Appl. No.: 17/433,369

(22) PCT Filed: Nov. 28, 2019

(86) PCT No.: PCT/JP2019/046620
§ 371 (c)(1),
(2) Date: Aug. 24, 2021

(87) PCT Pub. No.: WO2020/183810
PCT Pub. Date: Sep. 17, 2020

(65) Prior Publication Data

US 2022/0170285 A1 Jun. 2, 2022

(30) Foreign Application Priority Data

Mar. 13, 2019 (JP) ..... 2019-046229

(51) Int. Cl.
*E02B 3/10* (2006.01)
*E04H 9/14* (2006.01)

(52) U.S. Cl.
CPC ..... *E04H 9/145* (2013.01); *E02B 3/106* (2013.01)

(58) Field of Classification Search
CPC ..... E04H 9/145; E02B 3/106
See application file for complete search history.

(56) References Cited

U.S. PATENT DOCUMENTS 6,338,594 B1 * 1/2002 Adler ..... E02D 5/182
10,161,093 B2 * 12/2018 Adler ..... E02B 7/36
(Continued)

FOREIGN PATENT DOCUMENTS

DE 20 2013 011 807 U1 11/2014
GB 2472245 A 2/2011
(Continued)

OTHER PUBLICATIONS

Extended European Search Report issued in corresponding application, EP 19 91 8887; Dated: Oct. 21, 2022.
(Continued)

*Primary Examiner* — Kyle Armstrong
(74) *Attorney, Agent, or Firm* — Pearne & Gordon LLP

(57) ABSTRACT

Provided is a multiplex water cutoff wall with a simple structure that can control water infiltration into an interior by way of being provided with multiple water cutoff walls and having a configuration to drain water having infiltrated between the water cutoff walls with a drainage means such as a pump. A plurality of water cutoff walls 1A, 1B, 1C, 1D are disposed in a multiplex configuration with gaps in the wall thickness direction. Drain pumps 4*a*, 4*b*, 4*c* are provided as the drainage means for discharging water having infiltrated between the water cutoff walls 1A, 1B, 1C, 1D to the outside. Water that has infiltrated between the water cutoff walls 1A and 1B when a rise in water level is caused outside the multiplex water cutoff wall during flooding is discharged to the outside of the multiplex water cutoff wall by the drain pump 4*a*. If necessary, the water cutoff wall can be arranged into a multiplex configuration with a third water cutoff wall 1C and a fourth water cutoff wall 1D, and water infiltrating therebetween is discharged with the drain pumps 4*b*, 4*c*. Thus, the level of infiltrating water is lower nearer the interior, and water flood damage can be prevented to a
(Continued)

structure in the interior protected by the multiplex water cutoff wall.

7 Claims, 4 Drawing Sheets

(56) References Cited

U.S. PATENT DOCUMENTS

| | | | | |
|---|---|---|---|---|
| 11,286,631 | B2 * | 3/2022 | Adler | E02B 7/38 |
| 2002/0083651 | A1 * | 7/2002 | Nomura | E02B 3/102 52/64 |
| 2016/0244927 | A1 | 8/2016 | Adler | |

FOREIGN PATENT DOCUMENTS

| | | | |
|---|---|---|---|
| GB | 2486463 | A | 6/2012 |
| JP | 2001-032621 | A | 2/2001 |
| JP | 2002-161523 | A | 6/2002 |
| JP | 3113333 | U | 9/2005 |
| JP | 4435512 | B1 | 3/2010 |
| JP | 2016-138372 | A | 8/2016 |
| JP | 2017-089133 | A | 5/2017 |
| JP | 2018-003278 | A | 1/2018 |
| JP | 2018-096114 | A | 6/2018 |
| JP | 2019-0007292 | A | 1/2019 |
| KR | 10-1342128 | B1 | 12/2013 |
| WO | 2016/131002 | A1 | 8/2016 |

OTHER PUBLICATIONS

International Search Report for corresponding International Application No. PCT/JP2019/046620 mailed Jan. 28, 2020.

Written Opinion for corresponding International Application No. PCT/JP2019/046620 dated Jan. 28, 2020.

Office Action issued in corresponding Chinese application, 201980093966.5; dated Jul. 8, 2023.

* cited by examiner

MULTIPLEX WATER CUTOFF WALL

TECHNICAL FIELD

This invention relates to a multiplex water cutoff wall provided with water cutoff walls disposed doubly or at least triply with gaps in the wall thickness direction and a drainage means for discharging water having infiltrated between the water cutoff walls to the outside, and this multiplex water cutoff wall is installed in places such as the entrance of a detached house, a multiple dwelling house, a hotel, an office building, a hospital building, a factory building or other general building structures and the periphery of a structure, as well as an opening of a flood barrier constructed around the structure, for instance.

BACKGROUND ARTS

It is known that abnormal weather in recent years has brought about damage caused by flooding and/or storm surges far more frequently than estimated. For coping with such damage caused by flooding and/or storm surges, there exist some conventional arts disclosed in the following patent documents 1 to 4, for instance, as technologies for preventing inundation into buildings.

The patent document 1 discloses a water cutoff device which comprises a water cutoff plate having a predetermined area, a box body with the water cutoff plate housed therein or mounted thereon, a lower locking member and an upper locking member, wherein the water cutoff plate when placed underground in a state of being housed in the box body is held in a condition in which a water cutoff plate surface is nearly level with a ground surface, whereas the water cutoff plate when locked with the lower and upper locking members after being manually raised results in being capable of preventing intrusion of flooded rainwater, river water, seawater or like floodwaters.

The patent document 2 discloses an emergency-use waterproof retaining wall which is constituted such that during normal times, a bed plate and a cover plate for protecting a U-shaped groove in the bed plate are placed in a state of being embedded underground without hindrance to an entrance/exit to a structure such as a building, whereas when flooding occurs, the retaining wall is built so as to be fenced around the structure just as a fence is built therearound by the manner in which after assembling of an individual waterproof retaining wall unit by inserting a sheathing board into the U-shaped groove with the cover plate removed and then connecting and fixing this sheathing board to the bed plate through a reinforcing material, the assembled waterproof retaining wall units are connected together, followed by sealing of an inter-unit clearance with a joint plate, thereby preventing inundation into the interior of the retaining wall.

The patent document 3 discloses, as one inundation preventing device which can be speedily assembled on a passageway such as a building entrance when an emergency situation such as heavy rain and flooding occurs, and also can exert a function of preventing inundation into the building, an inundation preventing device which is to prevent inundation into the building and comprises support materials provided on both side wall faces of a building passageway, a water cutoff panel for blocking the building passageway by joining both side end parts of the water cutoff panel by pressure to these support materials over the whole panel length, a panel receiving beam member provided on a passageway floor surface between the respective lower ends of the support materials to receive the lower end of the water cutoff panel, a first pressure joining means for joining the lower end of the water cutoff panel by pressure onto the panel receiving beam member and a second pressure joining means for joining the panel receiving beam member by pressure onto the passageway floor surface.

The patent document 4 discloses a waterproof shutter which is made to be watertight, wherein the waterproof shutter is installed in places such as the entrance of a building to prevent intrusion of water from outside into the building when an emergency situation occurs.

PRIOR ART DOCUMENTS

Patent Documents

[Patent document 1] Japanese Patent Publication No. 4435512

[Patent document 2] Japanese Utility Model Registration Publication No. 3113333

[Patent document 3] Japanese Unexamined Patent Application Publication No. 2018-096114

[Patent document 4] Japanese Unexamined Patent Application Publication No. 2016-138372

SUMMARY OF THE INVENTION

Problems to be Solved by the Invention

The invention disclosed in the patent document 1 is to provide the water cutoff device constituted so as to prevent the intrusion of floodwaters by the manner in which the water cutoff plate of the water cutoff device placed underground inconspicuously during normal times is locked after being manually raised when the emergency situation occurs, in which case however, this water cutoff device requires a large space for its placement, and besides, cannot be said to have a complete degree of water cutoff performance, so that insufficient maintenance thereof might cause degradation in water cutoff performance.

The invention disclosed in the patent document 2 is to provide the retaining wall constituted such that during normal times, the constituent members thereof are placed in the state of being embedded underground, similarly to the invention disclosed in the patent document 1, whereas when flooding occurs, the individual waterproof retaining wall unit is assembled to build the retaining wall so as to be fenced around the structure just as the fence is built therearound, and accordingly, this retaining wall involves the problems regarding a space for storage of the wall constituent members during normal times and/or height and area restrictions. Besides, it takes much time and labor to build this retaining wall so as to be fenced around the entire periphery of the structure when the emergency situation occurs, so that there is difficulty in application of this retaining wall to a building having a large plane cross section.

The invention disclosed in the patent document 3 is to provide the inundation preventing device constituted such that inundation into the building is prevented by the manner in which the passageway such as the building entrance is blocked when the emergency situation such as heavy rain and flooding occurs, in which case, however, this inundation preventing device requires a complicated mechanism for the purpose of enhancing the water cutoff performance in the periphery of the water cutoff panel, and besides, might degrade its water cutoff performance when a rise in water level is caused, thus resulting in no securement of a complete degree of water cutoff performance.

The invention disclosed in the patent document 4 is to provide the waterproof shutter installed in places such as the entrance of the building to prevent the intrusion of water from outside into the building when the emergency situation occurs, in which case, however, this waterproof shutter involves the problems similar to those of the invention disclosed in the patent document 3.

The present invention is achieved for settlement of the above problems in the prior arts, and an object of the present invention is to provide a multiplex water cutoff wall with a simple structure that can control water infiltration into an interior by way of being provided with multiple water cutoff walls and having a configuration to drain water having infiltrated between the water cutoff walls with a drainage means such as a pump.

Means for Solving the Problems

A multiplex water cutoff wall of the present invention comprises a plurality of water cutoff walls disposed doubly or at least triply with gaps in the wall thickness direction, and a drainage means for discharging water having infiltrated between the water cutoff walls to the outside.

While the multiplex water cutoff wall of the present invention is based on the assumption of being used mainly for coping with flood damage caused by localized torrential downpours, flooding, tsunami (or tidal waves) and storm surges by way of being assembled for use when there arises the risk of the occurrence of flood damage, it is to be understood that this multiplex water cutoff wall is applicable also to a wall acting as a water cutoff wall at all times or an openable-type water cutoff wall without being limited to the above.

The multiplex water cutoff wall of the present invention can make use of a water cutoff wall formed of panels such as a metal panel, a plastic panel and a cement-based panel, for instance.

The metal panel does not exhibit any problem regarding watertightness in a panel surface, whereas it is generally heavy in weight and also of a high cost compared with the plastic panel.

The plastic panel does not also exhibit any problem regarding watertightness in a panel surface, and besides, is generally light in weight compared with the metal panel and thus advantageous in respect to carrying and/or handling, whereas its resistance to water pressures would become an issue when a rise in water level is caused during inundation. It is herein to be noted that use of reinforced plastic, polycarbonate or like material having high strength would provide no demerit in panel strength. Further, for a transparent plastic panel, it has a merit of making outside visible even during inundation.

For the cement-based panel, it is heavy in weight and thus disadvantageous in respect to carrying and/or assembling, whereas the panel cost can be reduced. Further, in view of watertightness, use of a watertight concrete panel is allowed to enhance the watertightness.

One possible specific form of the multiplex water cutoff wall may be based on a configuration which is provided with supports disposed with a gap in the wall surface direction and each having two or at least three vertical guide grooves formed with gaps in the wall thickness direction, and a plurality of water cutoff panels vertically disposed in a shape in which both ends thereof are fitted into the guide grooves.

When the multiplex water cutoff wall is of low height, specifically, as low as 1 to about 1.5 m in height, for instance, fitting of the water cutoff panels into the guide grooves of the supports from above is executable relatively with ease, whereas when the multiplex water cutoff wall is made to be at least as high as 3 to 6 m in height, for instance, it is not easy to execute fitting of the water cutoff panels into the guide grooves of the supports from above, and accordingly, in which case, an insertion portion into which the water cutoff panel is to be inserted may be provided in a lower position or an intermediate height position of each support to pile up the water cutoff panels while successively pushing up the upper water cutoff panel upward.

For the securement of watertightness, a water cutoff material or like material is interposed between the upper and lower water cutoff panels and between the water cutoff panel and the support guide groove, followed by being pressed thereagainst with a pressing means as needed. The pressing means would be available in mechanical type or other types utilizing pneumatic or other fluid pressure.

The water cutoff material may be interposed also between the upper and lower water cutoff panels and/or in places such as the bottom of the lowermost water cutoff panel, in addition to between the guide groove and the water cutoff panel, thereby providing more enhanced water cutoff performance than the water cutoff performance secured as that of the water cutoff panel itself even in the absence of the drainage means.

Another possible specific form of the multiplex water cutoff wall may be based on a configuration in which the water cutoff panel forming the water cutoff wall is openable and closable in the horizontal or vertical direction along a guide member such as a guide groove and a guide rail, for instance.

In addition to the above, when the water cutoff panel is a type of panel not so heavy in weight, it may be possible also that during normal times, this water cutoff panel is placed in a state of being kept in another place, whereas when inundation caused by flooding would be expected to occur, both ends of the water cutoff panel are fixed between the supports installed in advance.

While a drain pump is commonly used as the drainage means for discharging the water having infiltrated between the multiple water cutoff walls to the outside, it is to be understood that a type of drain pump capable of dealing with even muddy water and/or seawater should be used in accordance with installation location conditions, because intrusion of muddy water is caused during flooding and/or intrusion of seawater can be caused due to tsunami or flooding which occurs in a place close to the seashore.

It is also to be understood that no limitation is particularly imposed on an installation position of the drainage means such as the drain pump, and thus, the drainage means may be installed in any position easy to operate. When a submerged pump is provided between the multiple water cutoff walls, use can be also made of an automatic operation type submerged pump which automatically starts operation when at least a constant water level is reached.

It may be considered that the multiplex water cutoff wall of the present invention is applied to or installed in places such as the entrance of the structure, the periphery of the structure and the opening of a flood barrier constructed around the structure, for instance. While the structure referred to here is assumed to be mainly a detached house, a multiple dwelling house, a hotel, an office building, a hospital building, a factory building and other general building structures, it is to be understood that all the structures which have to be prevented from the inundation caused by flooding shall be targeted, such as the entrance of an underground shopping center, the entrance of a subway station, a factory and an unmanned facility.

Particularly, as one possible flood control measures taken for the multiple dwelling house, the hotel, the office building, the hospital building or like building structures, it may be considered that a structure is provided in which a flood barrier made to be watertight is constructed around a building in a spacing relationship thereto so as to be in a shape which encloses nearly the entire periphery of the building except an opening serving as an entrance/exit during normal times, the flood barrier being configured in a type of wall made to be at least as tall as an inundation depth estimated to occur, as well as to have durability capable of resisting the water pressure at least as equal as that at the estimated inundation depth, and the multiplex water cutoff wall of the present invention is provided in the opening of the flood barrier, as an opening sealing means for sealing the opening during inundation.

Under the circumstances that damage caused by storm surges due to recent typhoons has become an issue, it is said that in Koto, Katsushika, Edogawa, Adachi, Arakawa and Sumida wards in Tokyo, Japan, for instance, there are several areas where inundation up to 3 to 5 m would be expected to occur, and in these areas, there might be a fear of taking ten days to about two weeks before resumption of the supply of electricity, gas and water/sewerage services.

In this case, horizontal refuge which is one refuge action of taking refuge in advance to a place out of an area where inundation would be expected to occur has been heretofore recommended instead of vertical refuge which is another refuge action of taking refuge to upper stories of the same building. However, in response to the above, there have been also a lot of opposing opinions stating that it would be difficult to seek safety without taking the vertical refuge.

For instance, in March, 2013, the Ministry of Land, Infrastructure, Transport and Tourism in Japan revised "Guidance for flood hazard mapping", and in this revised guideline, the inundation depth ranks are shown in a simplified form such that the number of inundation depth ranks is reduced from five as having been established in conventional hazard maps in accordance with rough estimate of inundation to three, that is, an inundation depth of at least 3.0 m (or inundation above a second floor), that of 0.5 to less than 3.0 m (or inundation above a first floor) and that of less than 0.5 m (or inundation below the first floor). This guideline also advises the local residents in an area where inundation up to 0.5 to 3.0 m would be expected to occur, such as "Be relaxed to take refuge by going upstairs in one's own house, when it is too late to take refuge to the outside of the house".

Even when an outside area of the flood barrier is inundated up to the water level as equal as or close to the estimated inundation depth so that it becomes hard for the residents to go into or out of the building, the inside of the flood barrier can be kept to a tranquil state, and consequently, the functions of the building itself are less impacted. Besides, even when the duration of inundation around the building is at least as long as one week, for instance, the building itself can be held in a safety state.

Effects of the Invention

The multiplex water cutoff wall of the present invention is provided with the multiple water cutoff walls and also has a configuration to drain water having infiltrated between the multiple water cutoff walls with the drainage means such as the pump, thus allowing water infiltration into the interior of the multiplex water cutoff wall to be controlled with a simple structure.

Namely, with respect to the first water cutoff wall, a certain degree of water leakage is permitted under water pressure applied during flooding, and in this condition, the water having leaked into an inter-wall space in the second or the third and the following water cutoff walls is drained in an early stage with the drainage means, so that burden on the second or the third and the following water cutoff walls can be reduced, thereby allowing water infiltration into the interior of the multiplex water cutoff wall to be controlled.

Accordingly, as compared with a conventional water cutoff wall which is to provide an enhanced water cutoff performance as much as possible only with a single water cutoff wall, the multiplex water cutoff wall of the present invention is smaller in the burden on each of the multiple water cutoff walls and/or that on the water cutoff material and the pressing means, and consequently, can be provided in a simple structure.

Figure 1:
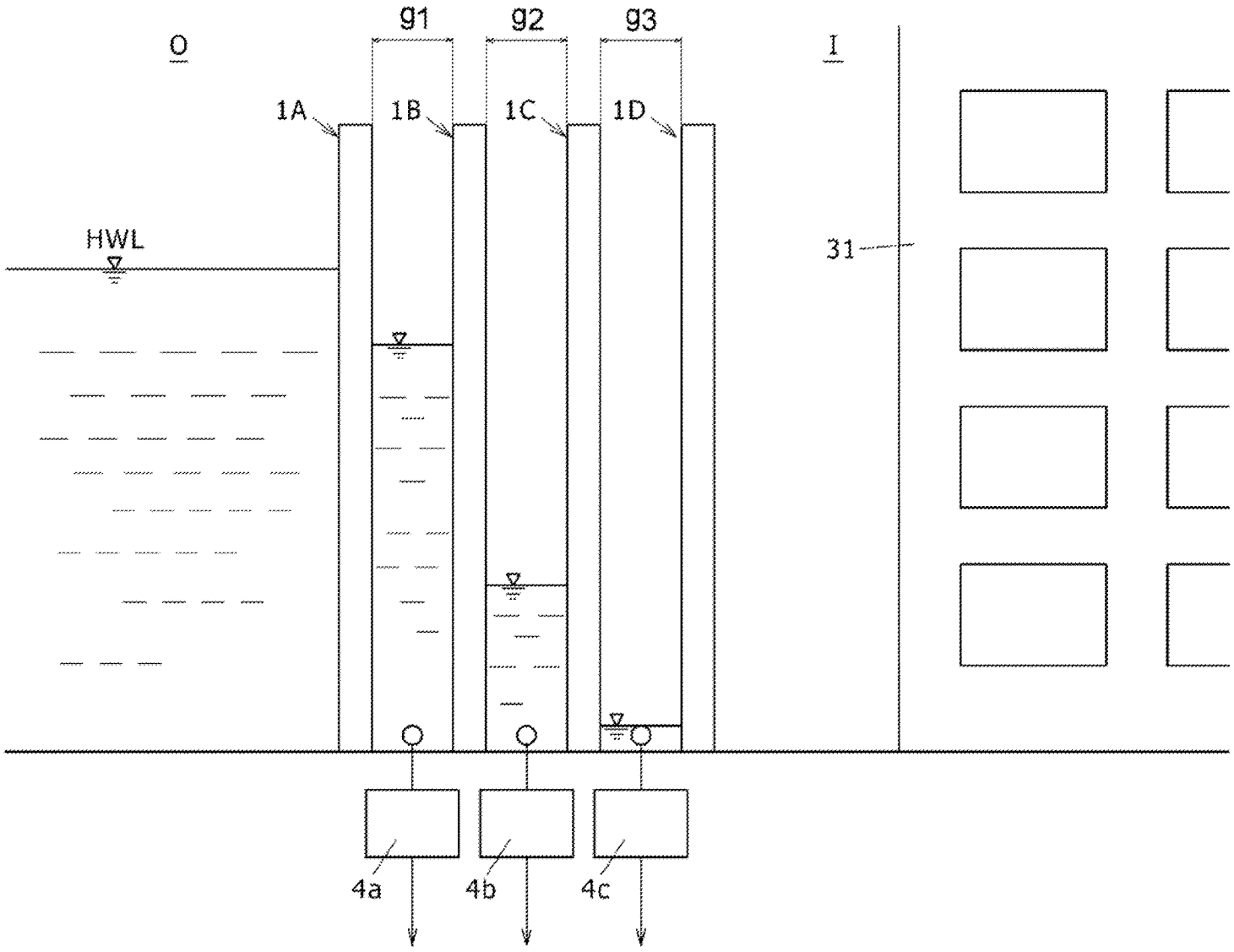
FIG. 1 is a view showing a multiplex water cutoff wall of the present invention in principle.
Figure 6:
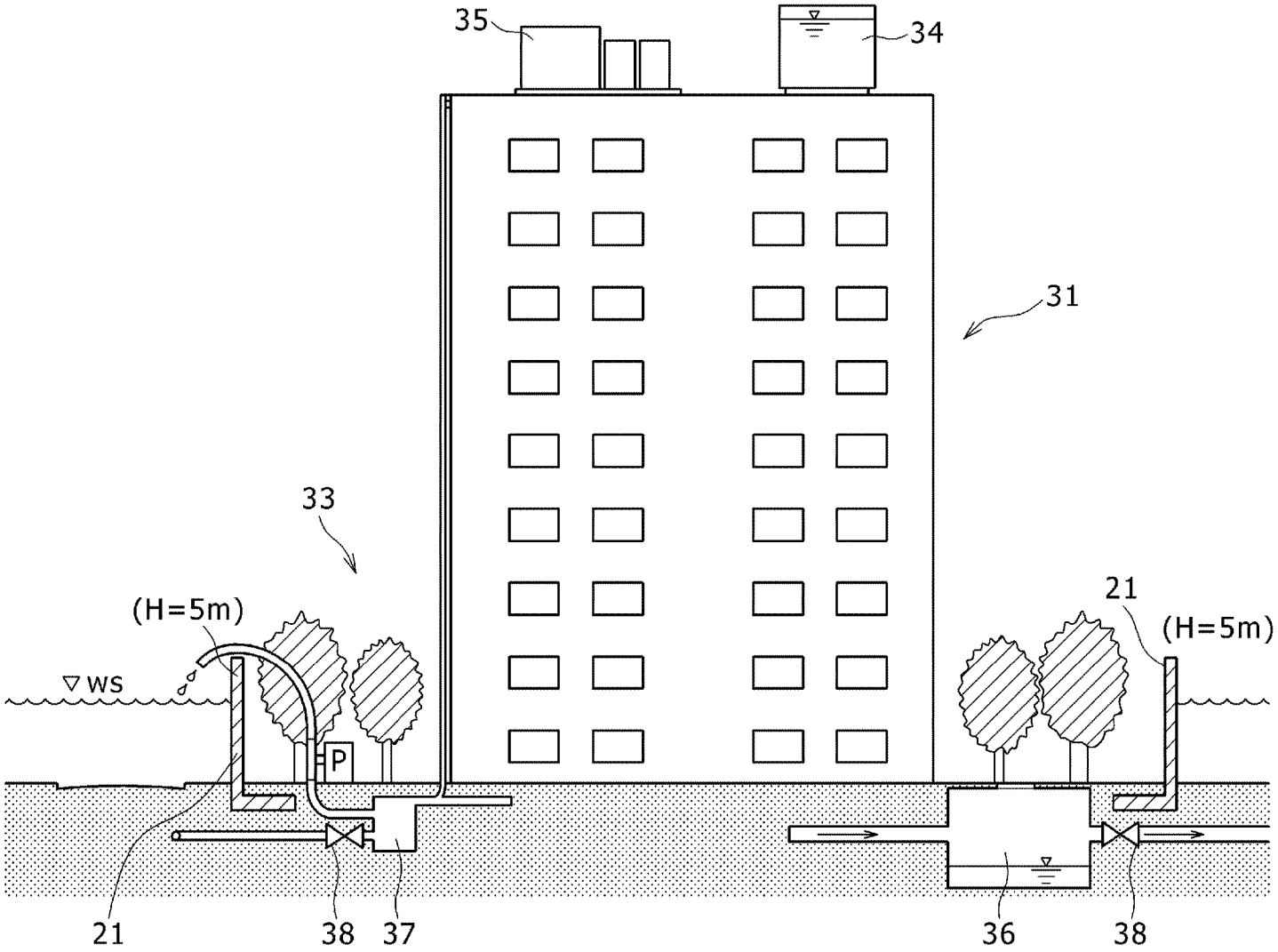
FIG. 6 is a view schematically showing a flood barrier in cases where the multiplex water cutoff wall of the present invention is applied to the flood barrier constructed around the site of a building.

The meanings of HWL, WS, P, and H presented in FIG. 1 and FIG. 6 are as follows: HWL=Height Water Level; P=Pump; WS=Water Surface; H-Height.

MODE FOR EMBODYING THE INVENTION

Hereinafter will be described the present invention with reference to the attached drawings.

FIG. 1 is a view showing a multiplex water cutoff wall of the present invention in principle, and this multiplex water cutoff wall is constituted of a plurality of water cutoff walls (or water cutoff walls 1A, 1B, 1C, 1D) disposed in a multiplex configuration with gaps g1, g2, g3 in the wall thickness direction and a drainage means (or drain pumps 4*a*, 4*b*, 4*c*) for discharging water having infiltrated between the water cutoff walls to the outside.

In cases where a water cutoff performance of the outermost water cutoff wall 1A can be completely secured when a rise in water level is caused outside (0) the multiplex water cutoff wall during flooding, no infiltration of water into the interior (I) would be caused, in which case, however, there is difficulty in securement of a complete degree of water cutoff performance in actuality, and besides, much cost is incurred. For that reason, the water cutoff walls 1A, 1B, 1C, 1D shall be laid out on the assumption that no complete degree of water cutoff performance is reached.

When the drain pump 4*a* for draining the infiltrating water is provided between the water cutoff walls 1A, 1B to discharge the infiltrating water to the outside of the multiplex water cutoff wall, the water level between the water cutoff walls 1A, 1B can be kept lower than the water level outside (0) the water cutoff wall 1A (or the water level of an outside area).

When the water cutoff walls disposed doubly will not do, the number of water cutoff walls shall be increased such that more multiple water cutoff walls such as the third and the fourth water cutoff walls 1C, 1D are disposed, and on this occasion, the water infiltrating between the respective water cutoff walls is discharged with the drain pumps 4*b*, 4*c*, as shown in FIG. 1. By so doing, the level of infiltrating water is lower nearer the interior to allow water infiltration into the interior of the multiplex water cutoff wall to be controlled, thereby preventing flood damage to a structure in the interior protected by the multiplex water cutoff wall.

Figure 2:
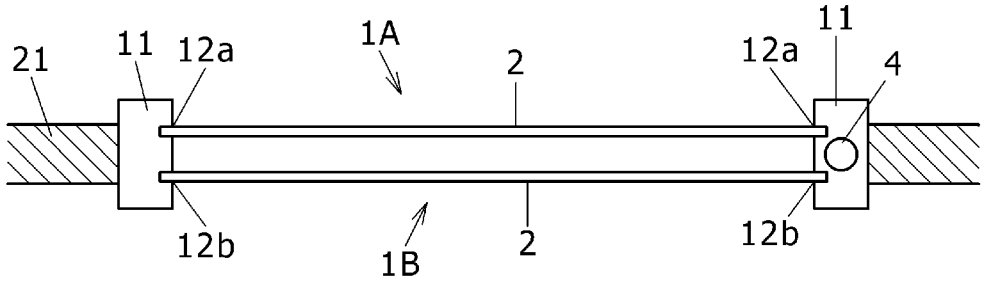
FIG. 2 is a horizontal sectional view showing one embodiment of the multiplex water cutoff wall of the present invention.
Figure 3:
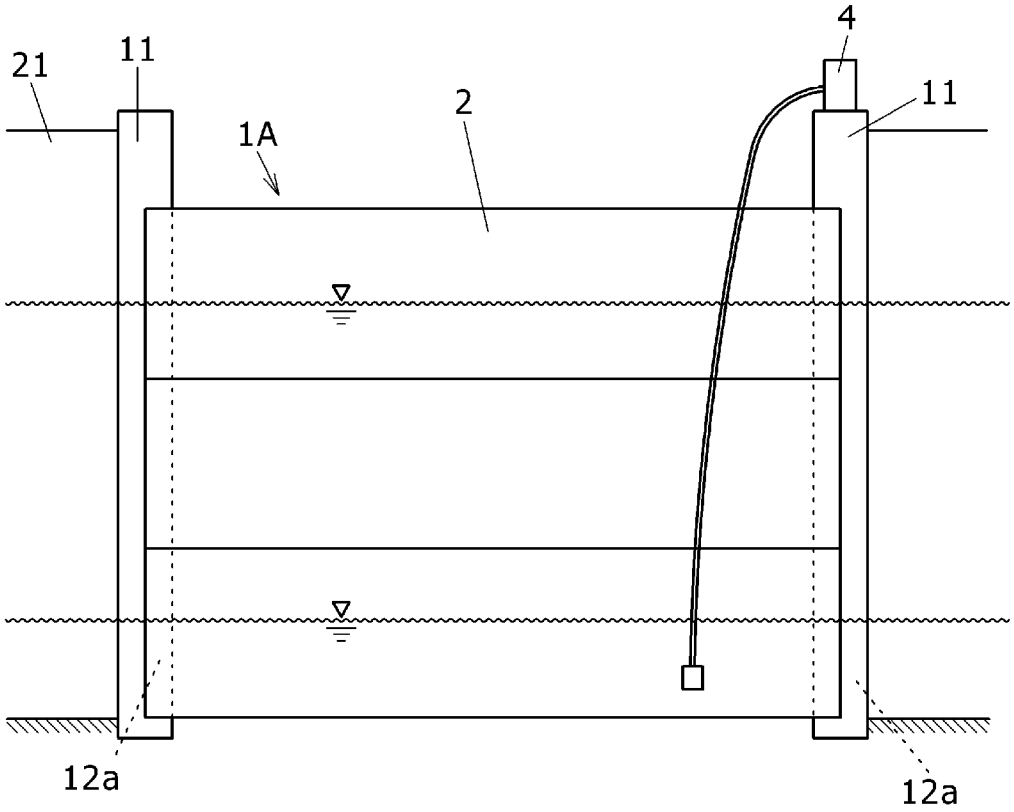
FIG. 3 is a vertical sectional view correspondingly showing the embodiment shown in FIG. 2.

FIG. 2 is a horizontal sectional view showing one embodiment of the multiplex water cutoff wall of the present invention, and FIG. 3 is a vertical sectional view correspondingly showing the embodiment shown in FIG. 2.

This embodiment is meant to indicate that the water cutoff walls 1A, 1B formed of water cutoff panels 2 are provided doubly between two supports 11 disposed with a gap. While this embodiment shown is based on the assumption of installation in an opening of a flood barrier 21 and the like, it is to be understood that no limitation is particularly imposed on a water cutoff wall installation position and/or size.

In this embodiment, the supports 11 are respectively provided with two vertically-extending guide grooves 12*a*, 12*b*, and the water cutoff panels 2 formed of reinforced plastic or metal plates and normally kept in a storage place are vertically disposed in three stages in a shape in which both ends of each water cutoff panel 2 are respectively fitted from above into the guide grooves 12*a*, 12*b* of the supports 11 facing each other. A commonly-used water cutoff material is interposed in the groove portions of the guide grooves 12*a*, 12*b* and/or between the water cutoff panels 2 to allow water leakage through clearances to be minimized.

It is to be herein noted that the present invention is not aimed at expecting any complete degree of water cutoff performance in each of the multiple water cutoff walls 1A, 1B, but is to allow the water level between the water cutoff walls 1A, 1B disposed doubly to be controlled lower than the water level outside the multiplex water cutoff wall by draining the infiltrating water to the outside with the drainage means such as the drain pump 4, on the assumption of the occurrence of water infiltration from the outside.

The water level between the water cutoff walls 1A, 1B disposed doubly is controlled lower so that the water pressure applied to the water cutoff wall 1B on the interior side is relatively lessened, thus allowing the amount of water infiltrating into the interior of the second water cutoff wall 1B to be controlled lower. While installation of the third and the fourth water cutoff walls inside the water cutoff walls disposed doubly as shown in FIG. 1 would result in allowing the water infiltration into the interior of the multiplex water cutoff wall to be more controlled in principle, it can be believed that the water cutoff walls disposed doubly or triply will do in usual conditions.

Figure 4:
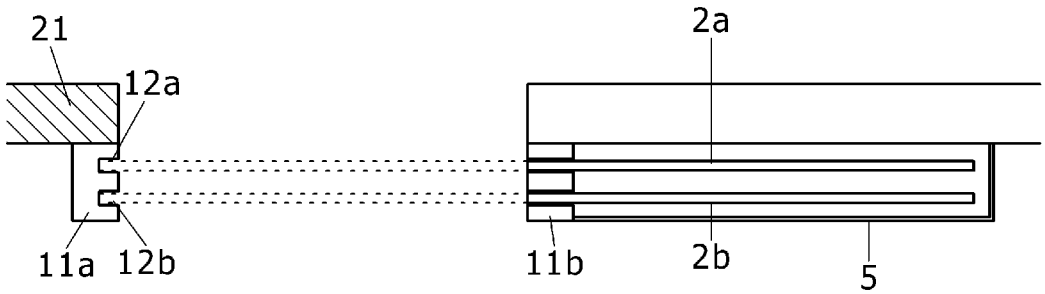
FIG. 4 is a horizontal sectional view showing another embodiment of the multiplex water cutoff wall of the present invention.
Figure 5:
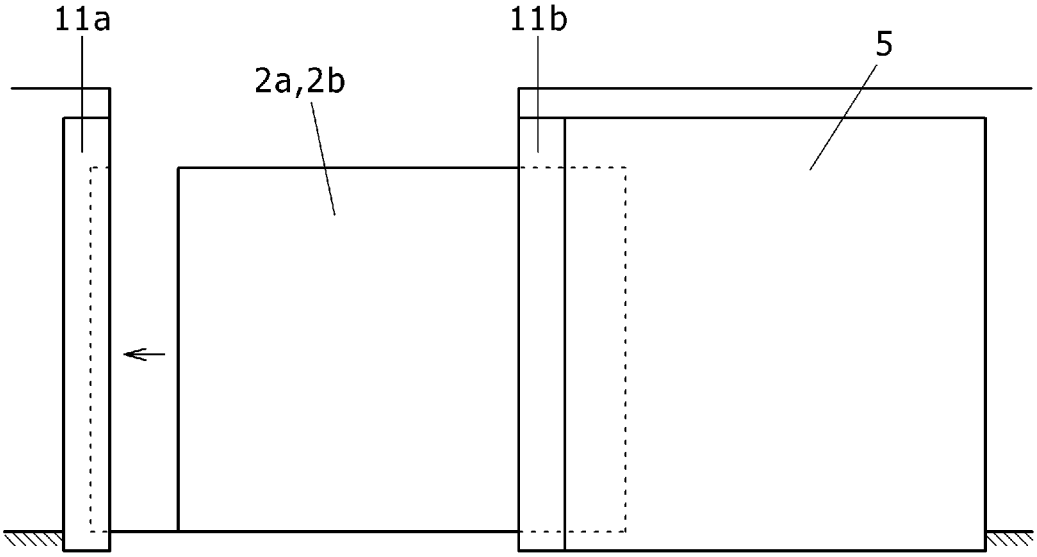
FIG. 5 is a vertical sectional view correspondingly showing the embodiment shown in FIG. 4.

FIG. 4 is a horizontal sectional view showing another embodiment of the multiplex water cutoff wall of the present invention, and FIG. 5 is a vertical sectional view correspondingly showing the embodiment shown in FIG. 4.

This embodiment is meant to indicate that openable-type water cutoff walls 1A, 1B formed of water cutoff panels 2*a*, 2*b* are provided doubly between two supports 11*a*, 11*b* disposed with a gap. While this embodiment shown is based on the assumption of installation in the opening of the flood barrier 21 and the like, it is to be understood that no limitation is particularly imposed on a water cutoff wall installation position and/or size.

In this embodiment, a side face of one support 11*b* is provided with a door pocket-shaped housing part 5 for housing the water cutoff panels 2*a*, 2*b*, wherein the water cutoff panels 2*a*, 2*b* housed in the housing part 5 can be moved slidably therefrom toward the other support 11*a* to seal the opening when the flood damage would be expected to occur.

This embodiment is similar to the embodiment shown in FIGS. 2 and 3 in the principle of water cutoff by the water cutoff walls disposed doubly or at least triply, together with the drainage means such as the drain pump.

FIG. 6 is a view schematically showing a flood barrier in cases where the multiplex water cutoff wall of the present invention is applied to a flood barrier opening. An embodiment shown in FIG. 6 is based on the assumption that a building 31 is the existing multiple dwelling house, and is also meant to indicate that in relation to flood-resistant renovation, the flood barrier 21 is constructed posteriorly in the site surrounding the building 31 so as to be in a shape which encloses nearly the entire periphery of the building 31

Structurally, the flood barrier 21 is constructed in the site surrounding the building 31 so as to be in the shape which encloses nearly the entire periphery of the building 31, and the multiplex water cutoff wall is provided in a section (not shown) serving as an entrance/exit during normal times such as the section leading to an entrance hall, to a parking place or to a place where residential wastes and others are to be carried out, wherein the multiplex water cutoff wall is provided as an opening sealing means for sealing the opening of the above section in a watertight manner. When there arises the risk of inundation caused by flooding or storm surges, the opening is sealed with the multiplex water cutoff wall (or the multiplex water cutoff wall shown in FIGS. 2 to 5), thereby forming a tranquil space 3 isolated inside the flood barrier 2.

The flood barrier 21 is made to be at least as tall as an inundation depth estimated to occur in an area where the building 31 is located, and hence, the flood barrier height can be arbitrarily set to be at least as equal as the estimated inundation depth in consideration of the securement of safety even in a state of emergency, such as at least 2 to about 3 m for the estimated inundation depth up to 2 m, at least 4 to about 5 m for that up to 4 m, and at least 5 to about 6 m for that up to 5 m, for instance.

The flood barrier 21 shall be watertight and can be formed by placing L-shaped blocks of watertight concrete side by side, followed by interposing a water cutoff material such as packing between the L-shaped blocks, for instance. Alternatively, the flood barrier 21 may be also formed of cast-in place concrete.

Of course, the flood barrier 21 shall have a structure and durability which are capable of sufficiently resisting dynamic and static water pressures applied thereto during flooding and/or storm surges, and accordingly, a buttress and/or a stay is additionally installed as needed.

Further, the occurrence of inundation up to a great depth might involve the problems regarding an underground flow and/or a backflow in sewerage pipes, and hence, the flood barrier 21 shall also have a structure capable of overcoming such problems. Specifically, the depth of embedment of the flood barrier 21 may be set deeper and/or a foundation part of the flood barrier 21 may be subjected to ground improvements as needed. Further, a check valve 38 may be provided in a pipeline leading to the outside.

While the flood control measures through the flood barrier 21 is to enable safe vertical refuge with ease, it is to be understood that there exists the need to cope with even a situation in which the duration of inundation in the area around the building is at least as long as one week, for instance, because of the fact that the residents would not be basically allowed to go into or out of the building by land when the inundation up to a great depth is caused in the area around the building.

Accordingly, in this embodiment, an emergency-use water receiving tank 34 is installed, together with an emergency-use generator 35, on the rooftop of the building 31 separately from a normal-use water receiving tank, and besides, an emergency-use septic tank 36 is also installed underground in the site, whereby the living environment of a long-term refuge at least as long as one week to about one month can be ensured, for instance. Further, on the occasion of the occurrence of significantly high precipitation caused by heavy rainfall, a rainwater storage tank 37 installed underground in the site is applied to control a rise in water level resulting from rainfall inside the flood barrier 21. Thus, rainwater fallen in a place enclosed with the flood barrier 21 can be once stored in the rainwater storage tank 37 and then drained to the outside of the flood barrier 21 with the drain pump as needed.

In this embodiment, the periphery of the building 31 is enclosed with the tall flood barrier 21, so that there would be such problems that a hindrance to sunlight or like natural lighting by the flood barrier 21 may result in creation of the shade and/or some residents on the first and the second floors of the building may be caused to have a cooped-up feeling, in which case, however, the problems regarding the hindrance to natural lighting and/or the resident's cooped-up feeling can be relieved by way of providing a large-sized transparent window in the flood barrier 21.

For the window, use can be made of a polycarbonate window material or like window material, for instance, in view of strength and durability. Further, for the purpose of preventing damage to a window installing portion of the flood barrier 21, a steel window frame or like high-strength window frame can be also incorporated into the window installing portion to mount the window material thereto.

Moreover, the flood barrier 21 can be provided also in the form of a regionally symbolized spot-like structure by applying various decorations thereto in consideration of its external appearance, so that the building 31 is allowed also to raise its value of property.

EXPLANATION OF REFERENCE NUMERALS

1A, 1B, 1C, 1D . . . Water cutoff wall, 2, 2*a*, 2*b* . . . Water cutoff panel, 4, 4*a*, 4*b*, 4*c* . . . Drain pump, 5 . . . Housing part, 11, 11*a*, 11*b* . . . Support, 12*a*, 12*b* . . . Guide groove, 21 . . . Flood barrier, 31 . . . Building, 33 . . . Space, 34 . . . Water receiving tank, 35 . . . Emergency-use Generator, 36 . . . Septic tank, 37 . . . Rainwater storage tank, 38 . . . Check valve

The invention claimed is:

1. A multiplex water cutoff wall comprising:

at least two water cutoff walls disposed adjacent to one another with gaps therebetween in the wall thickness direction, a drainage means for discharging water having infiltrated between the at least two water cutoff walls to the outside, the at least two water cutoff walls each having at least two supports, wherein the at least two supports each have at least two vertical guides spaced apart from one another in the wall thickness direction, wherein the at least two vertical guides each comprises a groove formed in the wall thickness direction, the at least two water cutoff walls each having a plurality of water cutoff panels, and wherein an end of each of the plurality of water cutoff panels is configured to be fitted into one of the at least two vertical guides.

2. The multiplex water cutoff wall according to claim 1, wherein each of the at least two water cutoff walls is formed of metal panels, plastic panels, or cement-based panels.

3. The multiplex water cutoff wall according to claim 2, wherein each of the plurality of water cutoff panels is openable and closable in the horizontal or vertical direction along a guide member.

4. The multiplex water cutoff wall according to claim 1, wherein said drainage means includes a drain pump.

5. The multiplex water cutoff wall according to claim 1, wherein the multiplex water cutoff wall is installed in the entrance of a structure, the periphery of the structure, or an opening of a flood barrier constructed around the structure.

6. A flood-resistant building equipped with a flood barrier wherein a flood barrier made to be watertight is constructed around a building in a spacing relationship thereto so as to be in a shape which encloses nearly the entire periphery of the building except an opening serving as an entrance/exit during normal times, said flood barrier being configured in a type of wall made to be at least as tall as an inundation depth estimated to occur, as well as to have durability capable of resisting the water pressure at least as equal as that at the estimated inundation depth, and the multiplex water cutoff wall according to claim 1 is provided in said opening, as an opening sealing means for sealing the opening during inundation.

7. The multiplex water cutoff wall according to claim 1, wherein the at least two water cutoff walls comprise three or more water cutoff walls disposed adjacent to one another with gaps therebetween in the wall thickness direction.

* * * * *